US009603422B1

(12) United States Patent
Lazo-Antunez et al.

(10) Patent No.: US 9,603,422 B1
(45) Date of Patent: Mar. 28, 2017

(54) AUTOMATED HANDS-FREE UMBRELLA

(71) Applicants: Raynel Lazo-Antunez, Miami, FL (US); Bertha Rocio Andrade-Madriñan, Miami, FL (US)

(72) Inventors: Raynel Lazo-Antunez, Miami, FL (US); Bertha Rocio Andrade-Madriñan, Miami, FL (US)

(73) Assignee: DROIDBRELLA TECHNOLOGIES, INC., North Miami, FL (US)

( * ) Notice: Subject to any disclaimer, the term of this patent is extended or adjusted under 35 U.S.C. 154(b) by 0 days.

(21) Appl. No.: 15/058,496

(22) Filed: Mar. 2, 2016

(51) Int. Cl.

| | |
|---|---|
| ***A45B 25/14*** | (2006.01) |
| ***A45B 19/02*** | (2006.01) |
| ***A45B 25/18*** | (2006.01) |
| *A45B 25/00* | (2006.01) |

(52) U.S. Cl.
CPC ..... *A45B 25/143* (2013.01); *A45B 19/02* (2013.01); *A45B 25/18* (2013.01); *A45B 2025/003* (2013.01)

(58) Field of Classification Search
None
See application file for complete search history.

(56) References Cited

U.S. PATENT DOCUMENTS

| | | | | |
|---|---|---|---|---|
| 1,549,938 | A * | 8/1925 | Warner | B64C 39/064 244/139 |
| 3,053,480 | A * | 9/1962 | Vanderlip | B64C 27/54 244/17.13 |
| 3,392,935 | A * | 7/1968 | Allmand | B64C 29/0025 244/139 |
| 6,616,094 | B2 * | 9/2003 | Illingworth | B64C 11/001 244/12.1 |
| 7,469,857 | B2 * | 12/2008 | Voss | B64B 1/60 244/96 |
| 8,302,901 | B2 * | 11/2012 | Hatton | B64C 17/00 244/12.2 |
| 8,322,649 | B2 * | 12/2012 | Martin | B64C 17/06 244/23 C |
| 2015/0360777 | A1 * | 12/2015 | Mottale | B64D 47/08 244/17.11 |
| 2016/0106187 | A1 * | 4/2016 | Sloan | A45B 23/00 135/16 |

* cited by examiner

*Primary Examiner* — Noah Chandler Hawk
(74) *Attorney, Agent, or Firm* — Albert Bordas, P.A.

(57) ABSTRACT

An automated hands-free umbrella, having a controller unit integration module with a motor assembly. The motor assembly has a shaft and a directional propeller. A power module has a housing. The housing has a gas container module. The gas container module has a container having gas. Further having an umbrella canopy module, a handle assembly, and a data coordinator system module. The automated hands-free umbrella sustains itself in the air by controlling the umbrella's buoyancy or floatability with an incorporated gas, such as helium. Also has means to hover over a user, even as the user is stationary or while moving.

18 Claims, 6 Drawing Sheets

AUTOMATED HANDS-FREE UMBRELLA

BACKGROUND OF THE INVENTION

1. Field of the Invention

The present invention relates to umbrellas, and more particularly, to automated umbrellas.

2. Description of the Related Art

Applicants are not aware of any prior art suggesting the novel features of the present invention.

SUMMARY OF THE INVENTION

The present invention is a self-controlled motion hands-free umbrella and the method for controlling it. The present invention was created primarily for protection from sunrays, rain, snow, dust, etc. The present invention performs its duties based on its ability to follow from an approximately constant altitude, in sort of a capsule or more precisely, a hands-free umbrella canopy covering the user(s) being protected.

The present invention sustains itself in the air by controlling the umbrella's buoyancy or floatability with an incorporated gas, such as helium. The present invention also comprises means to hover over a user, even as the user is stationary or while moving.

More specifically, the present invention is an automated hands-free umbrella, comprising a controller unit integration module having a motor assembly. The motor assembly comprises a shaft and a directional propeller. A power module comprises a housing. The housing has a gas container module. The gas container module comprises a container having gas. The present invention further comprises an umbrella canopy module, a handle assembly, and a data coordinator system module.

The umbrella canopy module comprises exterior and interior panel faces. The gas container module further comprises valves positioned to release and collect the gas to and from an area defined between the interior panel face and the exterior panel face. In a preferred embodiment, the gas is helium and the umbrella canopy module is hermetically sealed.

The umbrella canopy module comprises a skeletal frame module that comprises a frame assembly and ribs. The housing is detachable from the handle assembly. The controller unit integration module further comprises a controller housing having a hole that the shaft extends through. The power module houses power cells that are fuel cell cartridges or batteries.

The skeletal frame module comprises weight positioning control modules comprising arms that extend from the housing. Each of the weight positioning control modules comprises a set of arms that are contained within a section defined by respective ribs, and each arm has a respective weight secured at the frame assembly. The weight positioning control modules comprise a module motor for each set of arms.

The present invention further comprises a directional stabilizer system module, environmental data sensors, surrounding navigation and distribution modules, and image data input collection modules comprising video cameras and a computer vision application. The video cameras are positioned at a base of each respective ribs. The video cameras face inwardly, generally towards a middle section below the umbrella canopy module.

It is therefore one of the main objects of the present invention to provide an automated hands-free umbrella.

It is another object of this invention to provide an automated hands-free umbrella that hovers over a user.

It is another object of this invention to provide an automated hands-free umbrella that protects a user from sunrays, rain, snow, dust, etc.

It is another object of this invention to provide an automated hands-free umbrella that is volumetrically efficient for carrying, transporting, and storage.

It is another object of this invention to provide an automated hands-free umbrella that can be readily assembled and disassembled without the need of any special tools.

It is another object of this invention to provide an automated hands-free umbrella, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
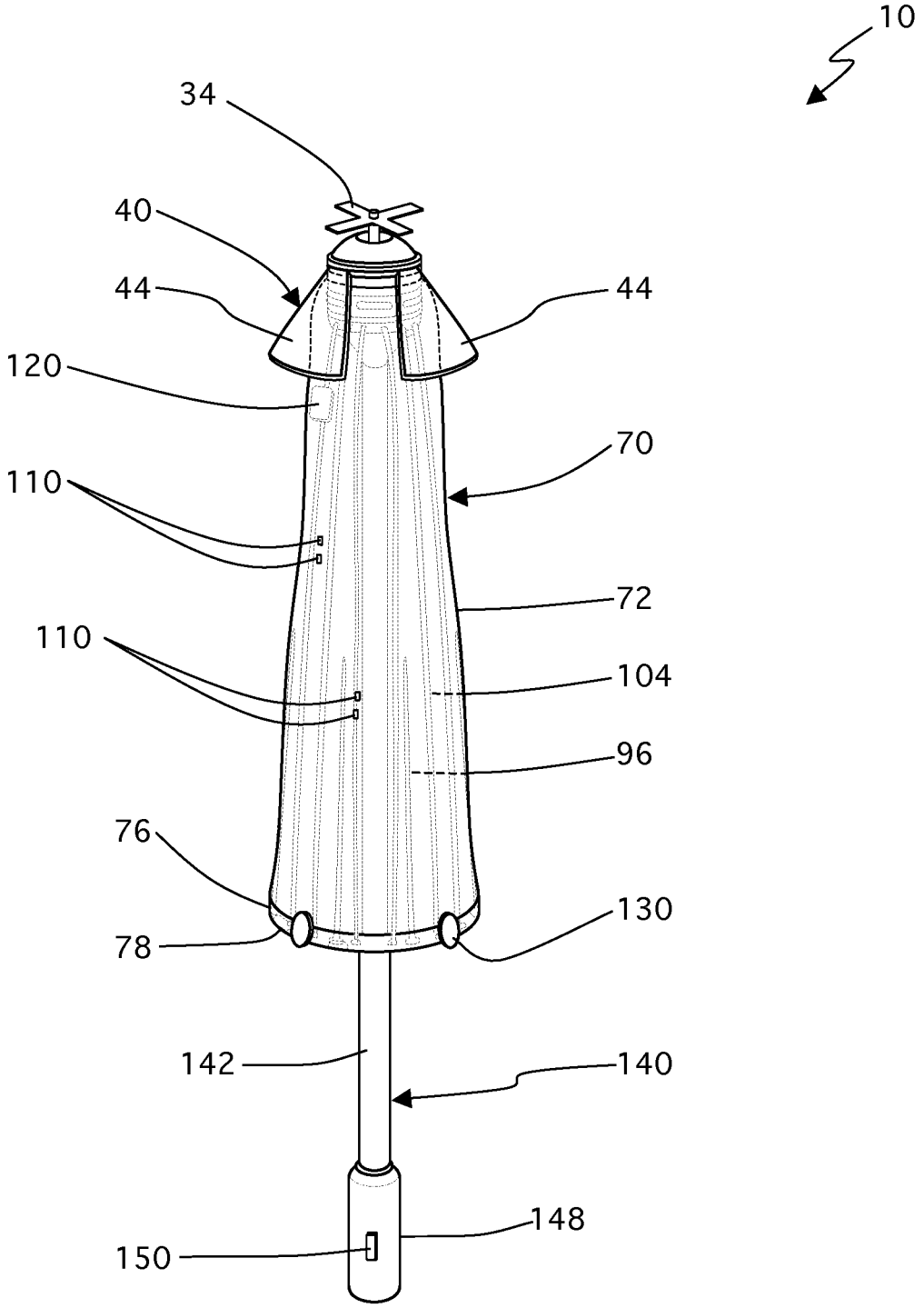
FIG. 1 represents an isometric view of an automated hands-free umbrella in a closed configuration.

Referring now to the drawings, the present invention is an automated hands-free umbrella and is generally referred to with numeral 10. It can be observed that it basically includes controller unit integration module 20, directional stabilizer system module 40, umbrella canopy module 70, and handle assembly 140.

Figure 2:
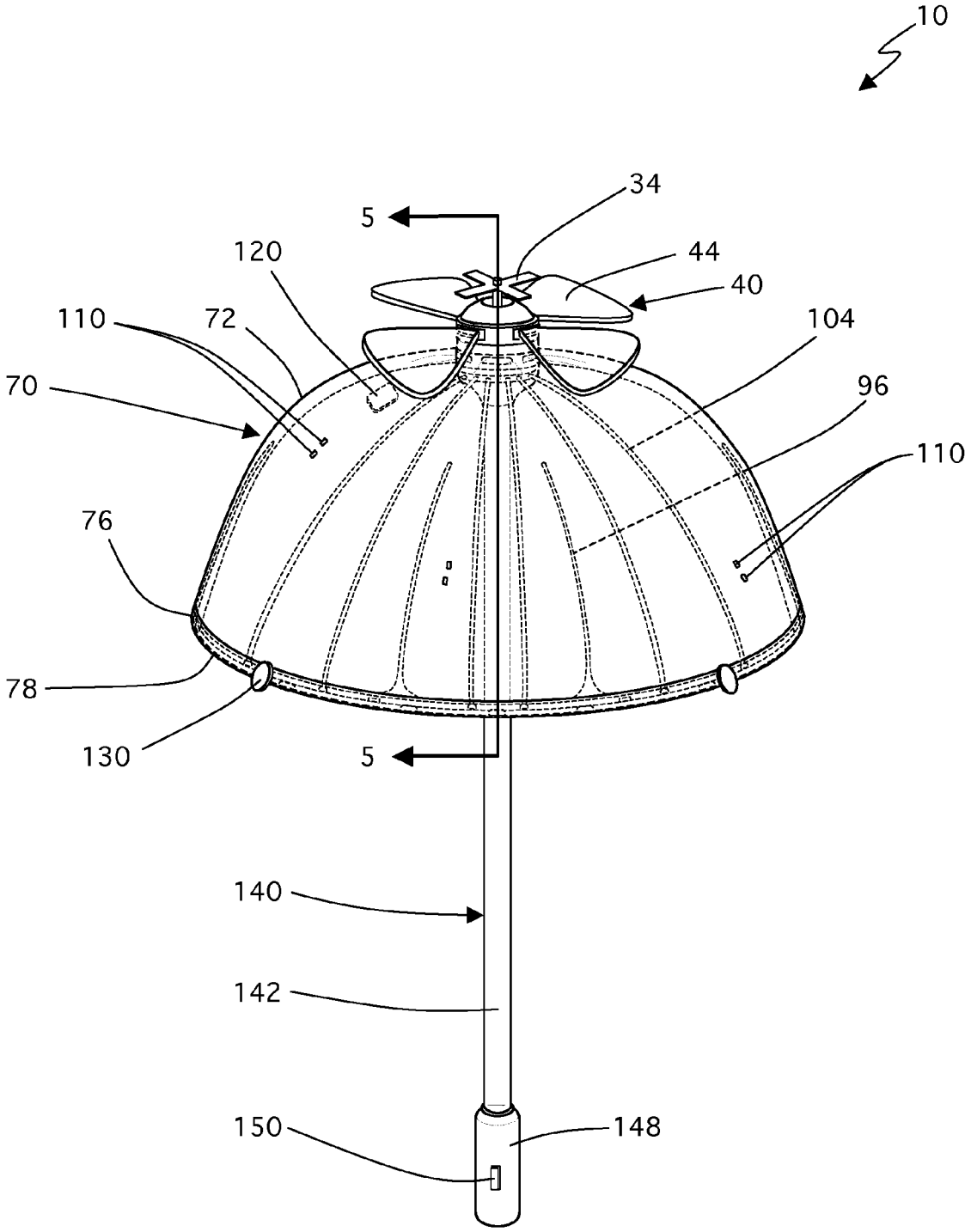
FIG. 2 represents a first isometric view of the automated hands-free umbrella in an open configuration.

As seen in FIGS. 1 and 2, handle assembly 140 comprises handle 148 having switch 150 thereon. Positioned above handle 148 is shaft 142. Positioned above shaft 142 is directional stabilizer system module 40 comprising directional stabilizers 44. Extending from directional stabilizer system module 40 is directional propeller 34. Positioned below directional stabilizer system module 40 is umbrella canopy module 70 that is hermetically sealed. Umbrella canopy module 70 comprises exterior panel face 72, and interior panel face 74, seen in FIG. 5, that extend to strip 76 and terminate at edge 78. Positioned on exterior panel face 72 are environmental data sensors 110. Positioned in between exterior panel face 72 and interior panel face 74 is data coordinator system module 120.

Data coordinator system module 120 is a computer, further defined as a programmable electronic device designed to accept data and perform prescribed mathematical and logical operations at high speed. More specifically, data coordinator system module 120 comprises a system unit. The system unit is the core of a computer system. Inside are electronic components that process information including a central processing unit (CPU), or microprocessor. Random access memory (RAM) temporarily stores information that the CPU uses while the computer is on. Wires plug into specific ports (openings). Hardware that is not part of the system unit is sometimes called a peripheral device or device. Data coordinator system module 120 may also comprise one or more disk drives and/or devices that store information. Data coordinator system module 120 may also comprise hard disk drives to store information. Data coordinator system module 120 may also comprise a modem to connect to the Internet allowing the present invention to be uniquely identified in the global domain via TCP IP4 and/or TCP IP6. Furthermore, data coordinator system module 120 may also comprise a GPS receiver, satellite antennas, and/or magnetometers. In a preferred embodiment, all data, content, and information are processed by data coordinator system module 120 with computer software.

Positioned at strip 76 of exterior panel face 72 are surrounding navigation and distribution modules 130. Surrounding navigation and distribution modules 130 comprise sensors to detect other automated hands-free umbrellas nearby. Surrounding navigation and distribution modules 130 collect data and send it to data coordinator system module 120 while being able to establish data exchange channels with other present inventions 10 and physically join/couple with their respective surrounding navigation and distribution modules 130 after having them synchronized to meet with each other.

Figure 3:
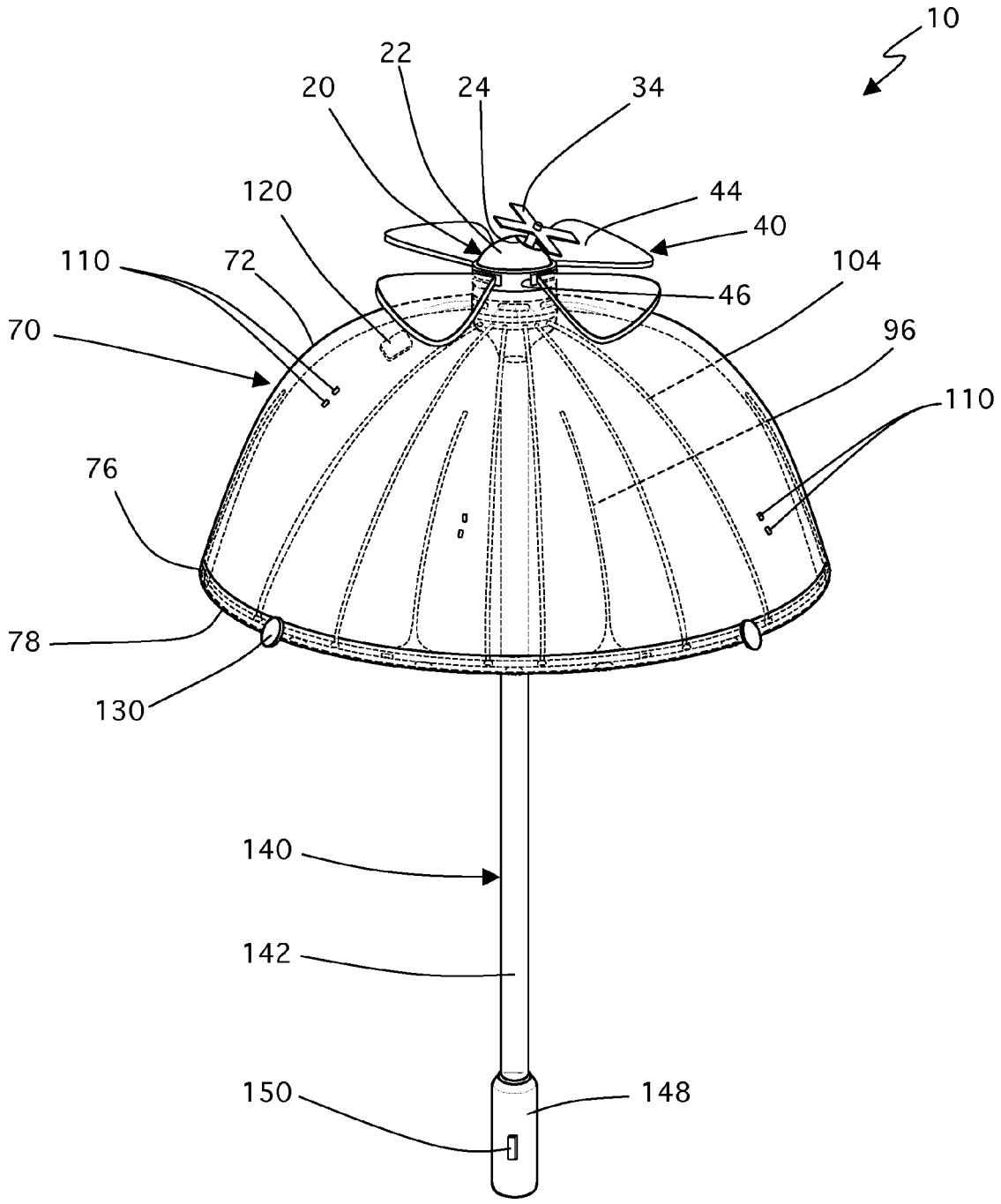
FIG. 3 represents a second isometric view of the automated hands-free umbrella in an open configuration while activating a directional propeller.

As seen in FIG. 3, controller unit integration module 20 comprises controller housing 22 having hole 24. Extending through hole 24 is directional propeller 34. In a preferred embodiment, controller housing 22 is semi-spherical in shape and pivots within directional stabilizer system housing 42, seen in FIG. 5, allowing directional propeller 34 to direct present invention 10 in various directions. Directional propeller 34 thus functions as steering means to steer present invention 10 above a user for protection from sunrays, rain, snow, dust, etc. Environmental data sensors 110 comprise wind, humidity, and pressure sensors that collect data and send it to data coordinator system module 120.

Figure 4:
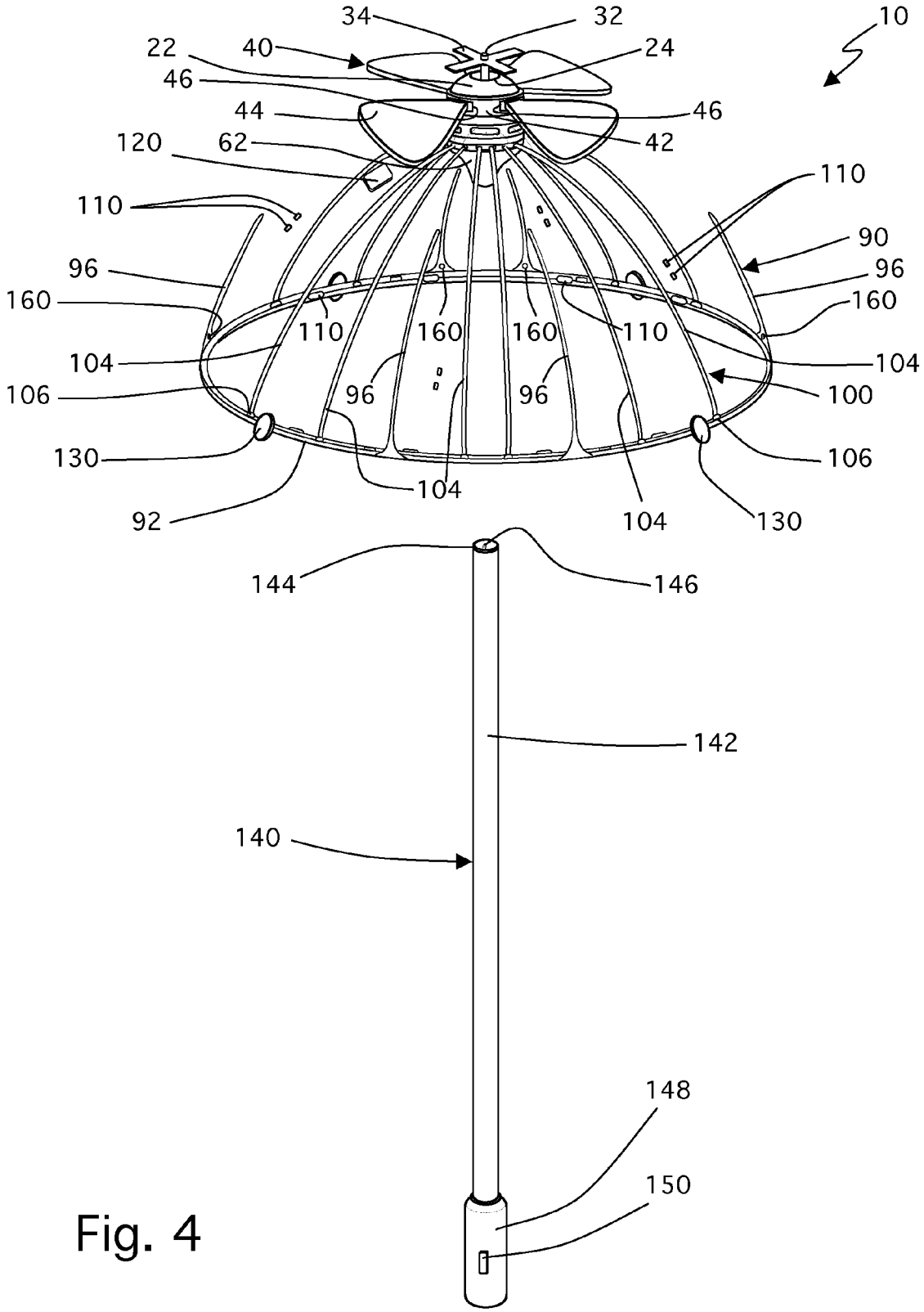
FIG. 4 represents a partial exploded view of the automated hands-free umbrella in an open configuration without its umbrella canopy module.
Figure 5:
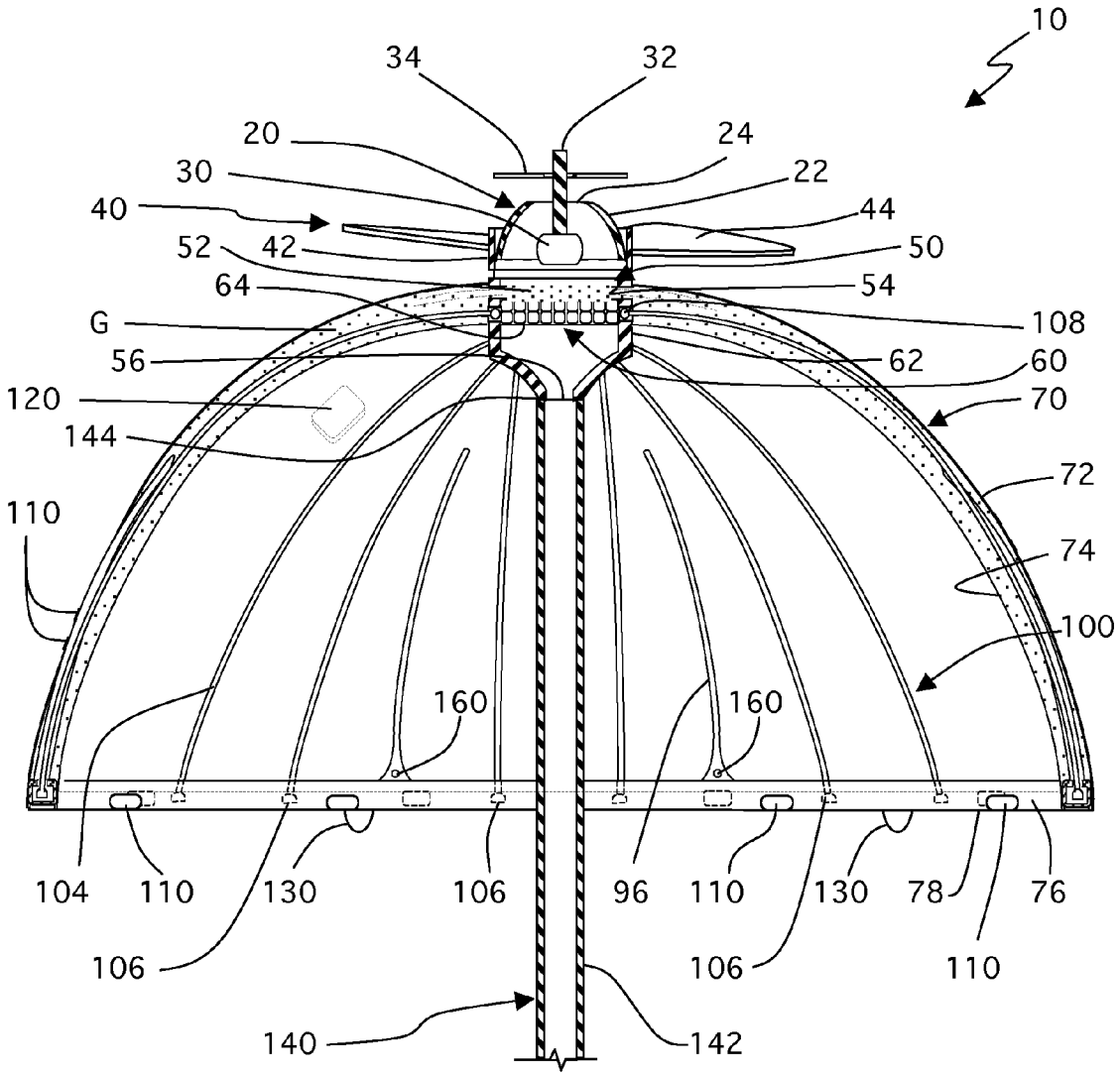
FIG. 5 represents a cut view of the automated hands-free umbrella in an open configuration taken along the lines 5-5 as seen in FIG. 2.

As seen in FIGS. 4 and 5, skeletal frame module 90 extends from housing 62 of power module 60. Skeletal frame module 90 comprises frame assembly 92. Extending from frame assembly 92 are a plurality of ribs 96 designed to function as a skeleton for umbrella canopy module 70. Skeletal frame module 90 further comprises weight positioning control module 100 comprising arms 104 that extend from housing 62.

Each weight positioning control module 100 comprises a set of arms 104 that are contained within a section defined by respective ribs 96, and each arm 104 has a respective weight 106 secured at frame assembly 92. Module motors 108 have means to shift arms 104 toward and away from each other, within their respective section. Therefore, shifting weights 106 to a desirable location within channel 80, seen in FIG. 8, to assist directional propeller 34 as steering means to steer present invention 10 above the user, whereby data coordinator system module 120 sends instructions to module motors 108. Upon receipt of the instructions, module motors 108 position arms 104 toward and away from each other, within their respective section. As best seen in this illustration, magnet 146 is affixed at end 144.

As also seen in FIGS. 4 and 5, environmental data sensors 110 are positioned at strip 76 of interior panel face 74. These environmental data sensors 110 comprise proximity and short-range movement data sensors that collect data and send it to data coordinator system module 120.

Image data input collection modules 160 is a computer vision system and software specialized on pose estimation and facial recognition capabilities, and more specifically, video cameras and a computer application capable of identifying or verifying a user from a digital image or a video frame from a video source. In a preferred embodiment, image data input collection modules 160 are positioned at a base of each respective rib 96 and face inwardly, generally towards a middle section below umbrella canopy module 70.

The computer vision system and software comprises facial recognition algorithms that identify facial features by extracting landmarks, or features, from an image of the user's face. For example, an algorithm may analyze the relative position, size, and/or shape of the eyes, nose, cheekbones, and jaw. These features are then used to search for other images with matching features. Other algorithms normalize a gallery of face images and then compress the face data, only saving the data in the image that is useful for face recognition. A probe image is then compared with the face data. Recognition algorithms can be divided into two main approaches, geometric, which looks at distinguishing features, or photometric, which is a statistical approach that distills an image into values and compares the values with templates to eliminate variances.

Three-dimensional recognition uses 3D sensors to capture information about the shape of a face along with volumetric depth information related to the focused object. This information is then used to identify distinctive features on the surface of a face, such as the contour of the eye sockets, nose, and chin. One advantage of 3D facial recognition is that it is not affected by changes in lighting like other techniques. It can also identify a face from a range of viewing angles, including a profile view. Three-dimensional data points from a face vastly improve the precision of facial recognition. 3D research is enhanced by the development of sophisticated sensors that do a better job of capturing 3D face imagery. The sensors work by projecting structured light onto the face. Up to a dozen or more of these image sensors can be placed on the same CMOS chip—each sensor captures a different part of the spectrum.

In a preferred embodiment, the computer vision system and software of present invention 10 captures the user's pose by using six tracking cameras, each positioned at a base of a respective rib 96, that way one camera will be pointing at the front of the user, others to the side, and the remaining pointing to the back of the user's head. All these cameras will work together so they can track the user's face and the overall user's head's volume with respect to interior panel face 74 in real time and be able to face detect and recognize. This information, data, is sent to data coordinator system module 120. As information and data is received by data coordinator system module 120 and processed, data coordinator system module 120 sends instructions to the various components of present invention 10, including motor assembly 30, directional stabilizer system module 40, gas container module 50, umbrella canopy module 70, skeletal frame module 90, weight positioning control module 100, and surrounding navigation and distribution modules 130 in an effort to sustain present invention 10 in the air by controlling buoyancy or floatability while hovering over the user, even as the user is stationary or while moving.

Mounted onto end 144 of shaft 142 is housing 62 of power module 60. In a preferred embodiment, power module 60 is a rechargeable power cells module that houses power cells 64. Housing 62 comprises end 56, and gas container module 50 having container 52. In a preferred embodiment, container 52 is filled with helium gas G. Container 52 comprises valves 54 that are positioned to release and collect helium gas G to and from an area defined between interior panel face 74 and exterior panel face 72.

Extending upwardly from housing 62 is directional stabilizer system housing 42 of directional stabilizer system module 40. Protruding through slots 46 of directional stabilizer system housing 42 is a plurality of directional stabilizers 44. Directional stabilizer system housing 42 partially contains controller unit integration module 20, whereby controller housing 22 is semi-spherical in shape and pivots within directional stabilizer system housing 42. Fixed onto a base of controller housing 22 is motor assembly 30.

Motor assembly 30 drives directional propeller 34 that is mounted onto shaft 32 to steer present invention 10 in various directions as instructed by data coordinator system module 120. More specifically, data coordinator system module 120 sends instructions to motor assembly 30. Upon receipt of the instructions, motor assembly 30 positions controller housing 22 at a desired orientation while activating shaft 32 having directional propeller 34 mounted thereon. It is noted that motor assembly 30 may position controller housing 22 in any orientation within 360 degrees, as seen in FIG. 3.

Directional stabilizer system module 40 helps steer present invention 10 in various directions as instructed by data coordinator system module 120. More specifically, data coordinator system module 120 sends instructions to directional stabilizer system module 40. Upon receipt of the instructions, stabilizer motors 48, seen in FIG. 6, position their respective directional stabilizers 44 at a desired orientation and pitch, and cause them to remain stationary or to flutter in an effort to help steer present invention 10 in the various directions as instructed by data coordinator system module 120. It is noted that the orientation, pitch, and overall movement of directional stabilizers 44 is limited by a perimeter defined by slots 46.

Container module 50, having container 52 filled with helium gas G, controls the buoyancy or floatability of umbrella canopy module 70 as instructed by data coordinator system module 120. More specifically, data coordinator system module 120 sends instructions to container module 50 and valves 54. Upon receipt of the instructions, valves 54 release and/or collect helium gas G to and from an area defined between interior panel face 74 and exterior panel face 72 to obtain a desired elevation over a user.

Switch 150 is an operational switch and in a preferred embodiment, also connects to data coordinator system module 120 via a wireless technology standard for exchanging data over short distances using short-wavelength UHF radio waves in the ISM band, while building a personal area network. Such a wireless technology standard can be "Bluetooth" as an example. Switch 150 is used to launch and reconnect umbrella canopy module 70.

As an operational switch, when switch 150 is activated at a first position, it sends a signal to data coordinator system module 120. Data coordinator system module 120 sends instructions to container module 50 and valves 54. Upon receipt of the instructions, valves 54 release and/or collect helium gas G to and from an area defined between interior panel face 74 and exterior panel face 72 to obtain a desired elevation over a user. In a preferred embodiment, housing 62 of umbrella canopy module 70 then detaches from end 144 and hovers approximately between 12"-36" over the user.

To reconnect, the user positions end 144 to end 56. When switch 150 is activated at a second position, it sends a signal to data coordinator system module 120. Data coordinator system module 120 sends instructions to container module 50 and valves 54. Upon receipt of the instructions, valves 54 collect helium gas G from the area defined between interior panel face 74 and exterior panel face 72 and store it in container 52.

Figure 6:
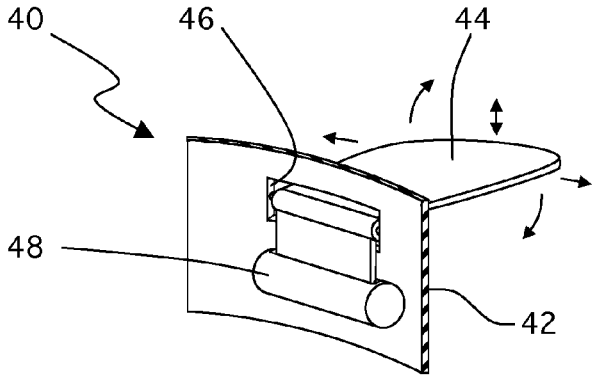
FIG. 6 represents a partial exploded view of a directional stabilizer and its respective stabilizer motor.

As seen in FIG. 6, protruding through slots 46 of directional stabilizer system housing 42 is a directional stabilizer 44. Stabilizer motors 48 position their respective directional stabilizers 44 at a desired orientation and pitch, and cause them to remain stationary or to flutter in an effort to help steer present invention 10 in the various directions as instructed by data coordinator system module 120.

Figure 7:
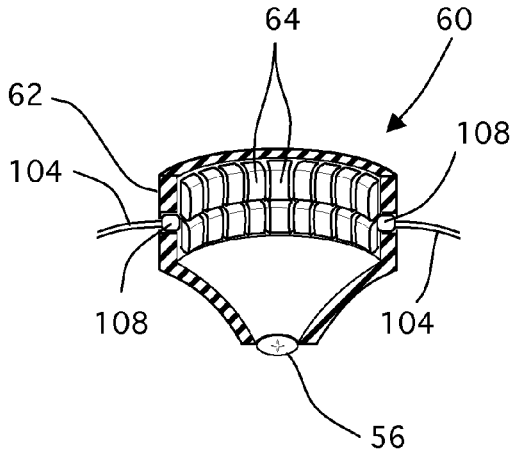
FIG. 7 represents a partial exploded view of the rechargeable power cells module.

As seen in FIG. 7, power module 60 houses power cells 64. In a preferred embodiment, power cells 64 are fuel cell cartridges or batteries that can be replaced as an array or individually. Power cells 64 provide power to present invention 10.

Figure 8:
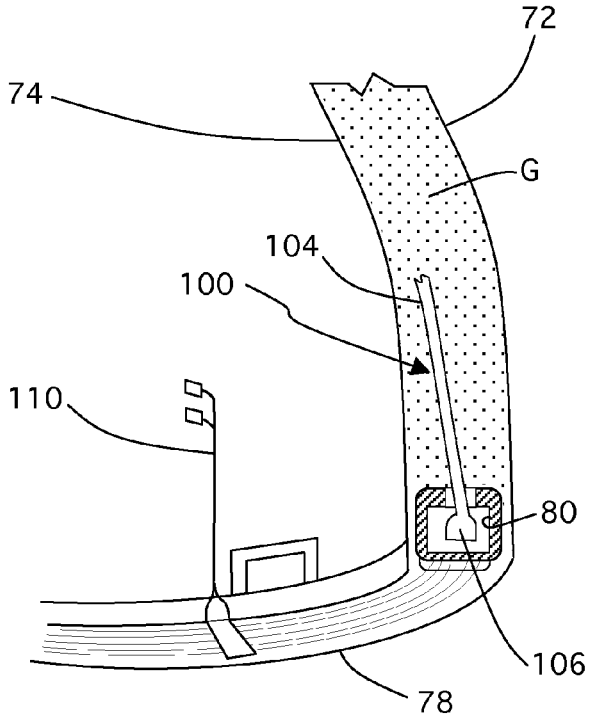
FIG. 8 represents a partial exploded view of the umbrella canopy module.

As seen in FIG. 8, helium gas G fills the area defined between interior panel face 74 and exterior panel face 72 to obtain a desired elevation over a user.

Figure 9:
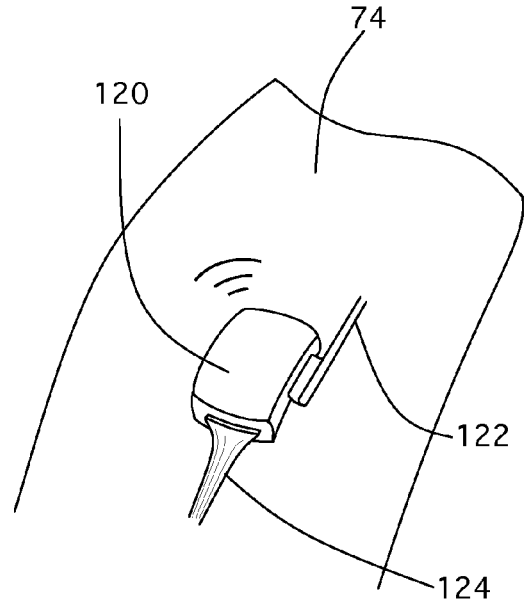
FIG. 9 represents a partial exploded view of the data coordinator system module.

As seen in FIG. 9, as the "brains" of present invention 10 and in a preferred embodiment, data coordinator system module 120 is hard wired with wires 124 to motor assembly 30, directional stabilizer system module 40, gas container module 50, power module 60, umbrella canopy module 70, skeletal frame module 90, weight positioning control module 100, environmental data sensors 110, surrounding navigation and distribution modules 130, and image data input collection modules 160. Power cable 122 connects to power module 60.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automated hands-free umbrella, comprising:

A) a controller unit integration module having a motor assembly, said motor assembly comprising a shaft and a directional propeller;

B) a power module comprising a housing, said housing having a gas container module, said gas container module comprising valves and a container having gas;

C) an umbrella canopy module comprising exterior and interior panel faces, said valves positioned to release and collect said gas to and from an area defined between said interior panel face and said exterior panel face;

D) a handle assembly; and

E) a data coordinator system module.

2. The automated hands-free umbrella set forth in claim 1, further characterized in that said gas is helium.

3. The automated hands-free umbrella set forth in claim 1, further characterized in that said umbrella canopy module is hermetically sealed.

4. The automated hands-free umbrella set forth in claim 1, further characterized in that said umbrella canopy module comprises a skeletal frame module.

5. The automated hands-free umbrella set forth in claim 4, further characterized in that said skeletal frame module comprises a frame assembly and ribs.

6. The automated hands-free umbrella set forth in claim 5, further characterized in that said skeletal frame module comprises weight positioning control modules comprising arms that extend from said housing.

7. The automated hands-free umbrella set forth in claim 6, further characterized in that each of said weight positioning control modules comprising a set of said arms that are contained within a section defined by respective said ribs, and each said arm has a respective weight secured at said frame assembly.

8. The automated hands-free umbrella set forth in claim 7, further characterized in that said weight positioning control modules comprise a module motor for each said set of said arms.

9. The automated hands-free umbrella set forth in claim 5, further comprising image data input collection modules comprising video cameras and a computer application.

10. The automated hands-free umbrella set forth in claim 9, further characterized in that said video cameras are positioned at a base of each respective of said ribs.

11. The automated hands-free umbrella set forth in claim 9, further characterized in that said video cameras face inwardly, generally towards a middle section below said umbrella canopy module.

12. The automated hands-free umbrella set forth in claim 1, further characterized in that said housing is detachable from said handle assembly.

13. The automated hands-free umbrella set forth in claim 1, further characterized in that said controller unit integration module further comprises a controller housing having a hole that said shaft extends through.

14. The automated hands-free umbrella set forth in claim 1, further characterized in that said power module houses power cells.

15. The automated hands-free umbrella set forth in claim 14, further characterized in that said power cells are fuel cell cartridges or batteries.

16. The automated hands-free umbrella set forth in claim 1, further comprising a directional stabilizer system module.

17. The automated hands-free umbrella set forth in claim 1, further comprising environmental data sensors.

18. The automated hands-free umbrella set forth in claim 1, further comprising surrounding navigation and distribution modules.

* * * * *